US006474632B1

(12) United States Patent
Liou

(10) Patent No.: US 6,474,632 B1
(45) Date of Patent: Nov. 5, 2002

(54) DRIVING MECHANISM FOR PLANK CLAMP

(76) Inventor: Ferng-Jong Liou, No. 101, Jong Shing Road, Sec. 2, Dah-Lii City, Taichung Hsien (TW)

( * ) Notice: Subject to any disclaimer, the term of this patent is extended or adjusted under 35 U.S.C. 154(b) by 0 days.

(21) Appl. No.: 09/985,980

(22) Filed: Nov. 7, 2001

(51) Int. Cl.[7] ..... B25B 1/00
(52) U.S. Cl. ..... 269/6; 269/170; 269/3
(58) Field of Search ..... 269/6, 3, 166–170, 269/226, 227, 225, 61, 204, 1; 81/487; 24/514, 522, 525

(56) References Cited

U.S. PATENT DOCUMENTS 4,436,294 A * 3/1984 Irelan ..... 269/6
4,770,401 A * 9/1988 Donaldson ..... 269/225
4,925,169 A * 5/1990 Lodrick, Sr. ..... 269/225
4,926,722 A * 5/1990 Sorensen et al. ..... 269/6
D346,942 S * 5/1994 Sawdon ..... D8/72
6,340,154 B1 * 1/2002 Young ..... 269/3
6,367,787 B1 * 4/2002 Poole et al. ..... 269/6

* cited by examiner

*Primary Examiner*—Lee Wilson
(74) *Attorney, Agent, or Firm*—Dennison, Schultz & Dougherty

(57) ABSTRACT

A driving mechanism for plank clamp includes a gear set and a rack mounted on a clamp main body to mesh with each other, a first sleeve tightly mounted on a rotary shaft of the gear set, and a coupling arm mounted on a shank of the first sleeve. When the coupling arm is pivotally turned about the rotary shaft toward the clamp main body, the first sleeve and the gear set are caused to rotate at the same time, and the rack meshing with the gear set is caused to move backward toward the clamp main body. A movable jaw fixedly connected to a free end of the rack is therefore moved toward the clamp main body, which also function as a fixed jaw of the plank clamp, to a desired position to tightly clamp a plank between it and the clamp main body.

7 Claims, 9 Drawing Sheets

DRIVING MECHANISM FOR PLANK CLAMP

BACKGROUND OF THE INVENTION

The present invention relates to a driving mechanism for plank clamp, in which a coupling arm is pivotally turned to rotate a gear set and to backward move a rack meshing with the gear set, so that a movable jaw connected to a free end of the rack is moved toward a clamp main body of the plank clamp.

FIG. 1 shows a conventional plank clamp currently available in the markets. A driving mechanism for the conventional plank clamp includes a pivotally turnable trigger A connected to a fixed jaw of the plank clamp and provided with a groove B, and an extension bar D movably connected to the fixed jaw of the plank clamp and having a movable jaw C fixedly connected to a free end thereof. When the trigger A is pivotally turned, the groove B is brought into an inclined position to get in tight contact with and push against the extension bar D to move the same, so that the movable jaw C could be shifted to a desired position relative to the fixed jaw.

A disadvantage of the above-described driving mechanism for the conventional plank clamp of FIG. 1 is that the extension bar D is moved through a tight frictional contact of the inclined groove B on the pivotally turned trigger A with the extension bar D to push the latter, and a user needs to apply a considerably big force to turn the trigger A and frictionally push the extension bar D. Thus, the user's hand operating the trigger A would soon become sore and stiff.

SUMMARY OF THE INVENTION

It is therefore a primary object of the present invention to provide an improved driving mechanism for plank clamp to eliminate the drawback existing in the conventional plank clamp.

The driving mechanism for plank clamp according to the present invention mainly includes a gear set and a rack mounted on a clamp main body to mesh with each other, a first sleeve tightly mounted on a rotary shaft of the gear set, and a coupling arm mounted on a shank of the first sleeve. When the coupling arm is pivotally turned about the rotary shaft toward the clamp main body, the first sleeve and the gear set are caused to rotate at the same time, and the rack meshing with the gear set is caused to move backward toward the clamp main body. A movable jaw fixedly connected to a free end of the rack is therefore moved toward the clamp main body, which also function as a fixed jaw of the plank clamp, to a desired position to tightly clamp a plank between it and the clamp main body.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
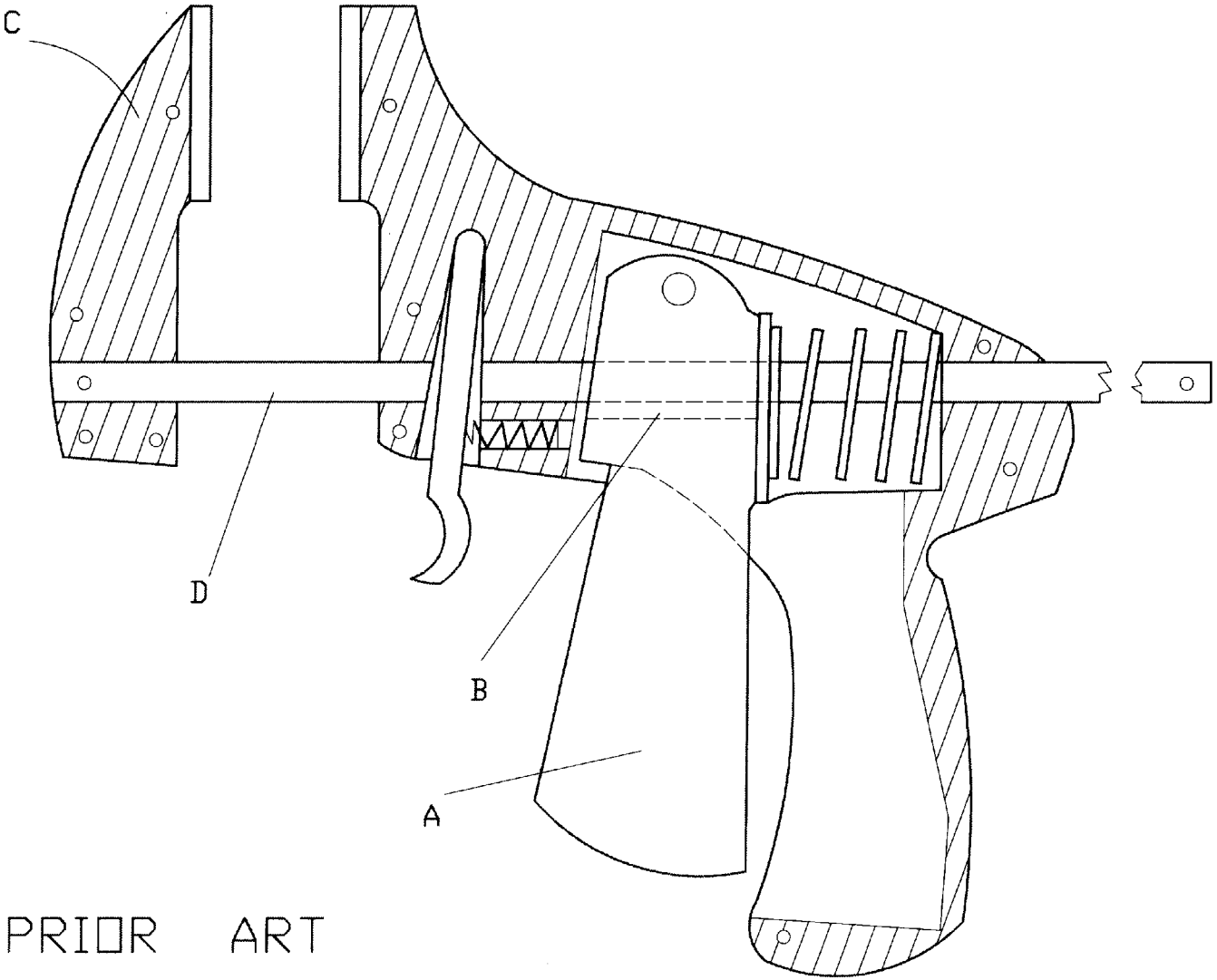
FIG 1 PRIOR ART
FIG. 1 is a partially sectioned side view of a conventional plank clamp.
Figure 2:
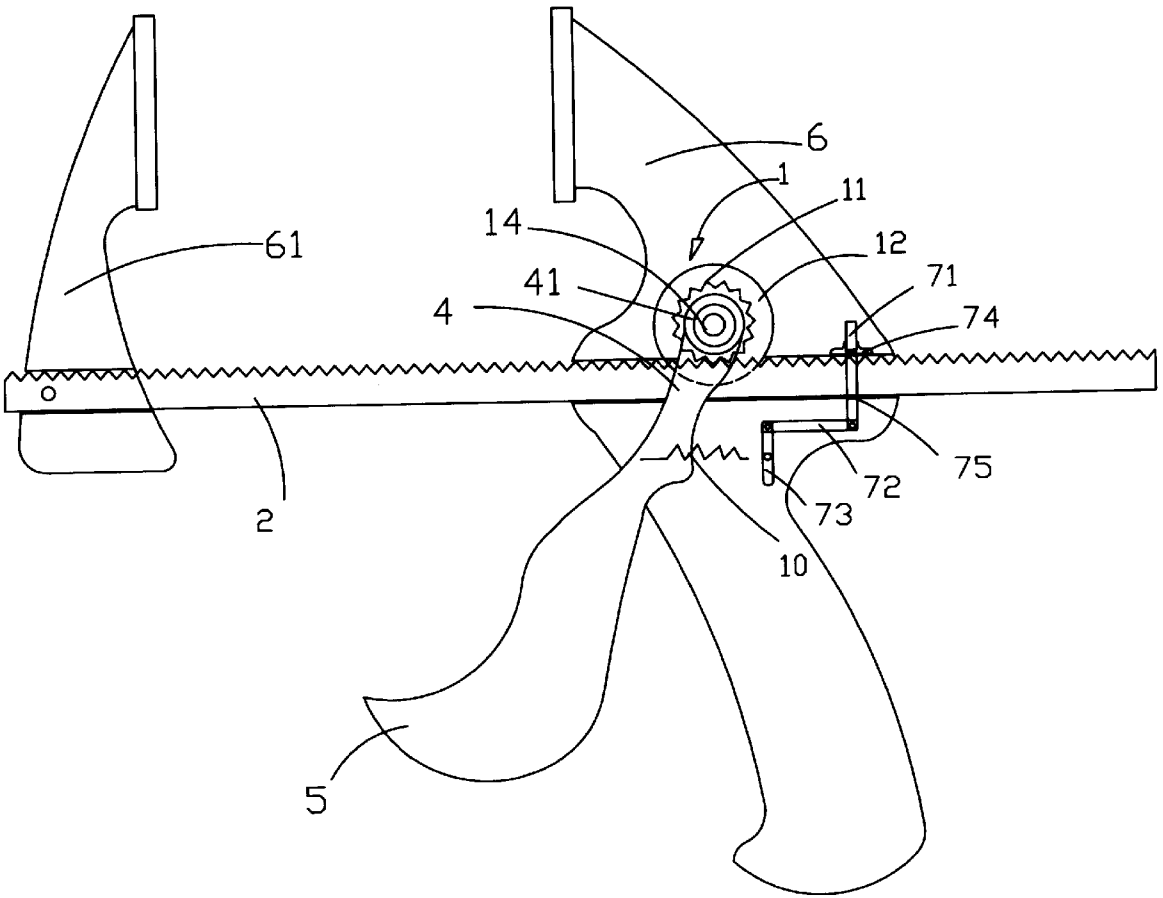
FIG. 2 is an assembled side view of a plank clamp having a driving mechanism according to the present invention.
Figure 3:
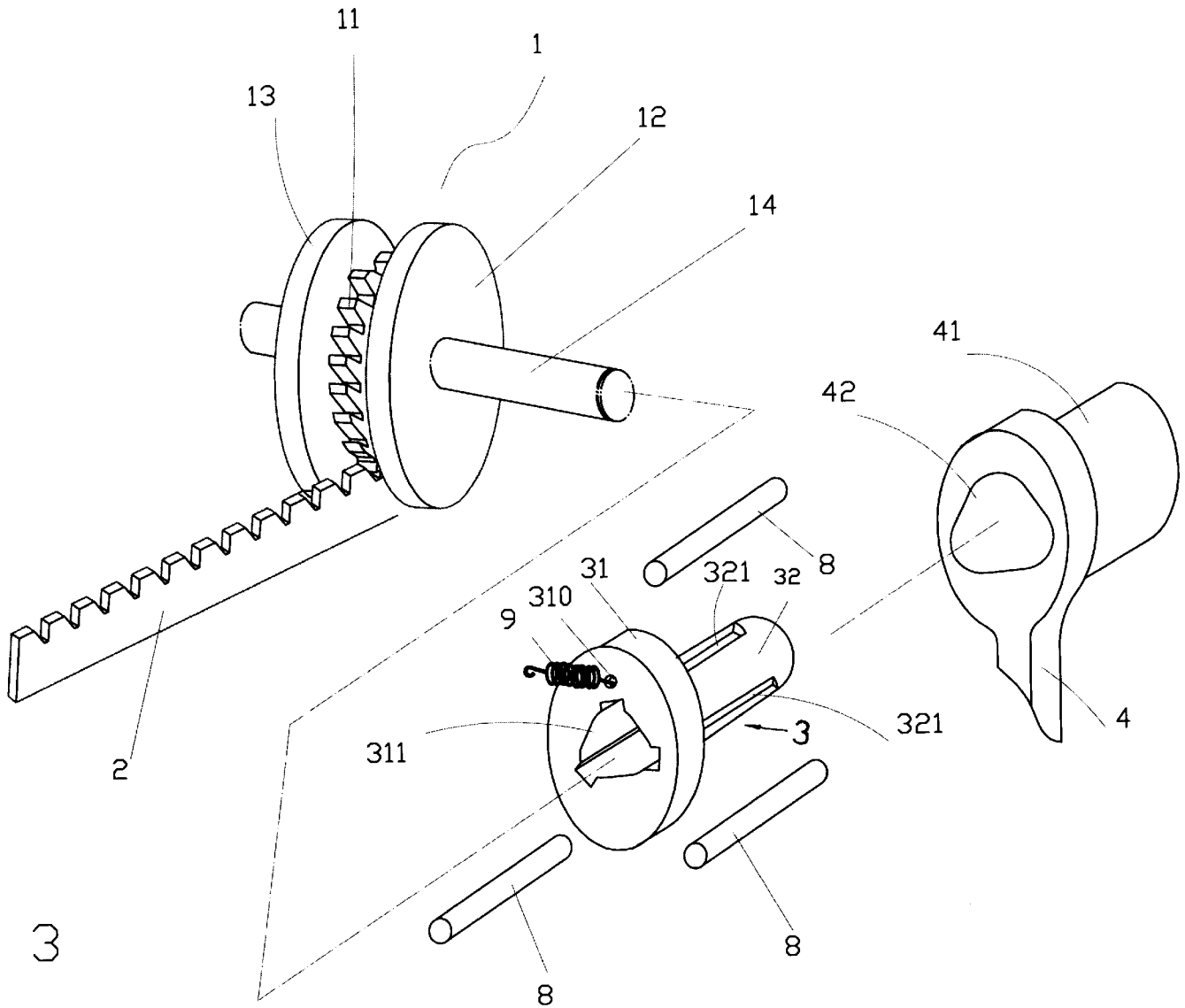
FIG. 3 is a fragmentary exploded perspective view of the driving mechanism of the present invention.

Please refer to FIGS. 2 and 3 in which a driving mechanism for plank clamp according to the present invention is shown. The driving mechanism mainly includes a gear set 1, a rack 2, a first sleeve 3, a coupling arm 4, a handle 5, a clamp main body 6 on which the gear set 1 and the rack 2 are mounted, and an auxiliary brake mechanism.

Figure 4:
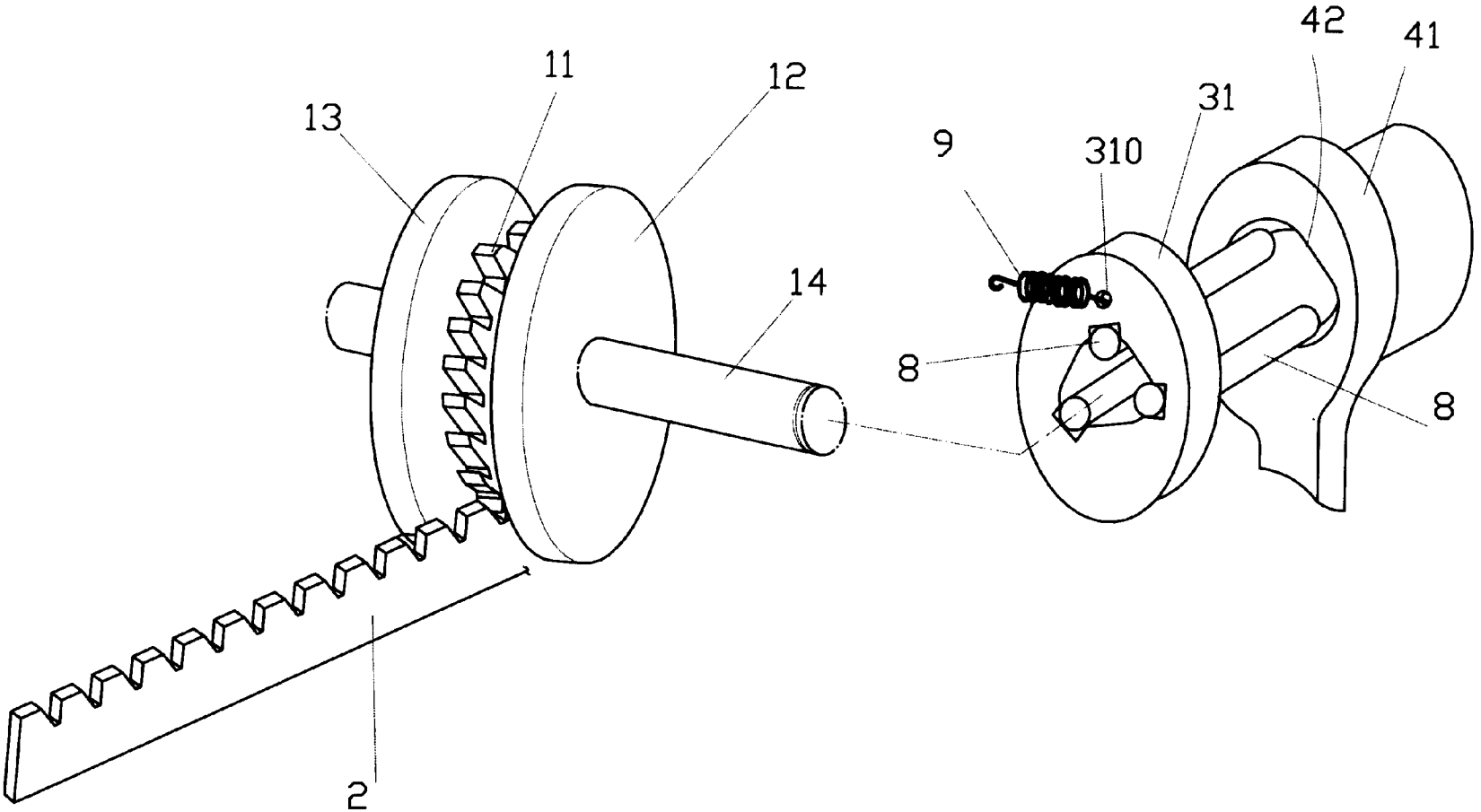
FIG. 4 is a partially assembled perspective view of the driving mechanism of FIG. 3.
Figure 5:
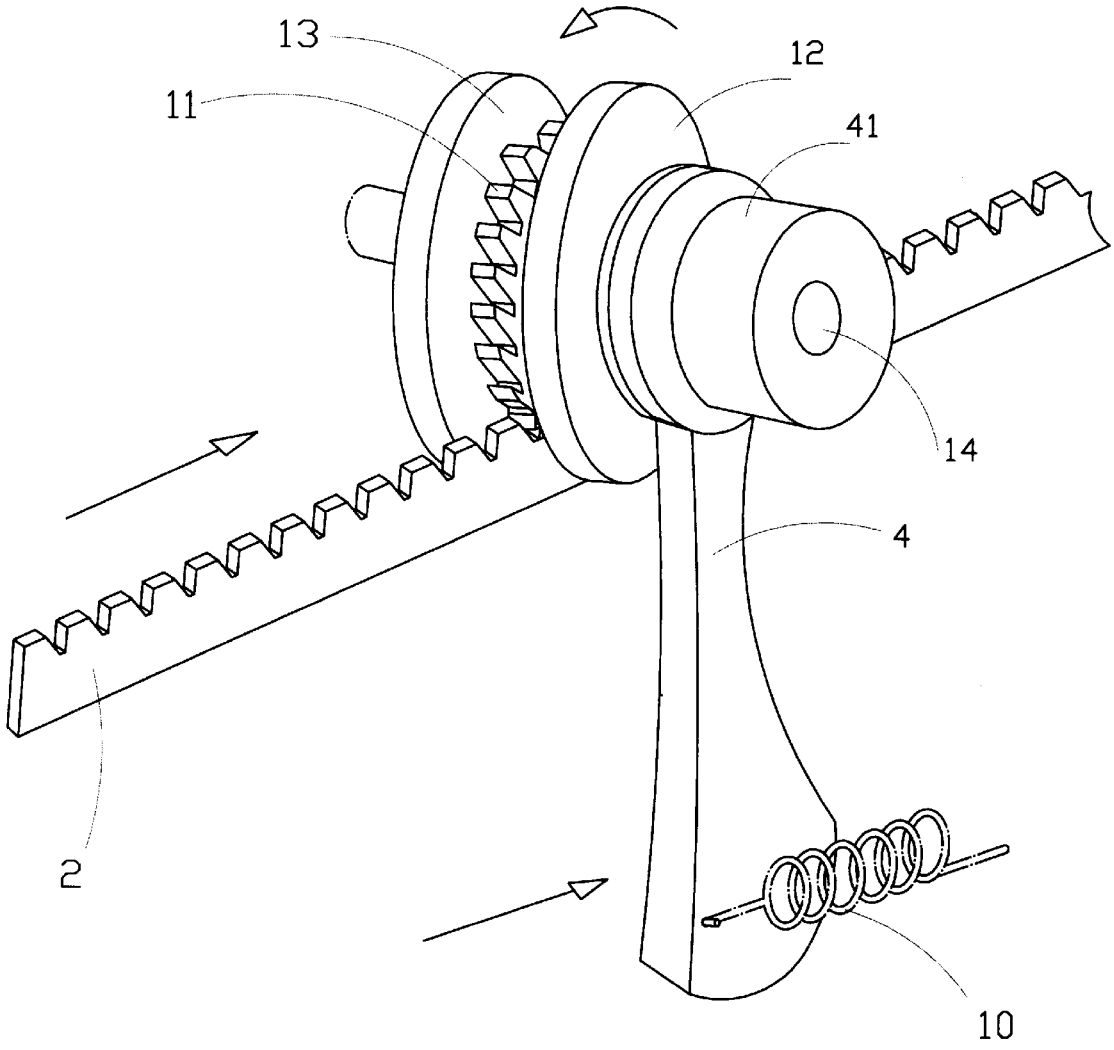
FIG. 5 is a fully assembled perspective view of the driving mechanism of FIG. 3.

Please refer to FIGS. 3, 4 and 5 at the same time. The gear set 1 includes a gear 11 and two wheels 12, 13 coaxially mounted on a rotary shaft 14. The two wheels 12, 13 are located at two sides of the gear 11 and have a diameter slightly larger than that of the gear 11, so that the gear 11 meshes with the rack 2 for the gear set 1 to stably move along the rack 2.

The first sleeve 3 includes a head disc 31 and a hollow shank 32 integrally and axially extended from one side of the head disc 31. The head disc 31 is formed at a predetermined position with a hole 310, so that a tension spring 9 is connected at a first end to the hole 310 and at a second end to the clamp main body 6 (see FIGS. 8 and 9) to provide a restoring force enabling the first sleeve 3 to return to an original position after it is rotated; and at a central area with an opening 311 having a cam-shaped profile and communicating with the hollow shank 32. The hollow shank 32 is provided on a circumferential surface with three axially extended long slots 321 communicable with an internal space of the hollow shank 32. Three rollers 8 that have an outer diameter slightly larger than that of the long slots 321 are separately positioned in the long slots 321, such that only one half of a volume of each roller 8 is received in the long slot 321.

The coupling arm 4 is integrally connected at a rear portion to the handle 5 and has a head portion providing a second sleeve 41. The second sleeve 41 is a hollow housing and has a bore 42 having a cam-shaped profile. An inner diameter of a cam circle defined by the bore 42 is close to an outer diameter of a circle defined by the three rollers 8 positioned in the long slots 321 on the shank 32. The shank 32 of the first sleeve 3 with the rollers 8 set in the long slots 321 could therefore be inserted into the bore 42 of the second sleeve 41 of the coupling arm 4 to couple the first sleeve 3 and the coupling arm 4 together, as shown in FIGS. 4 and 5.

Figure 6:
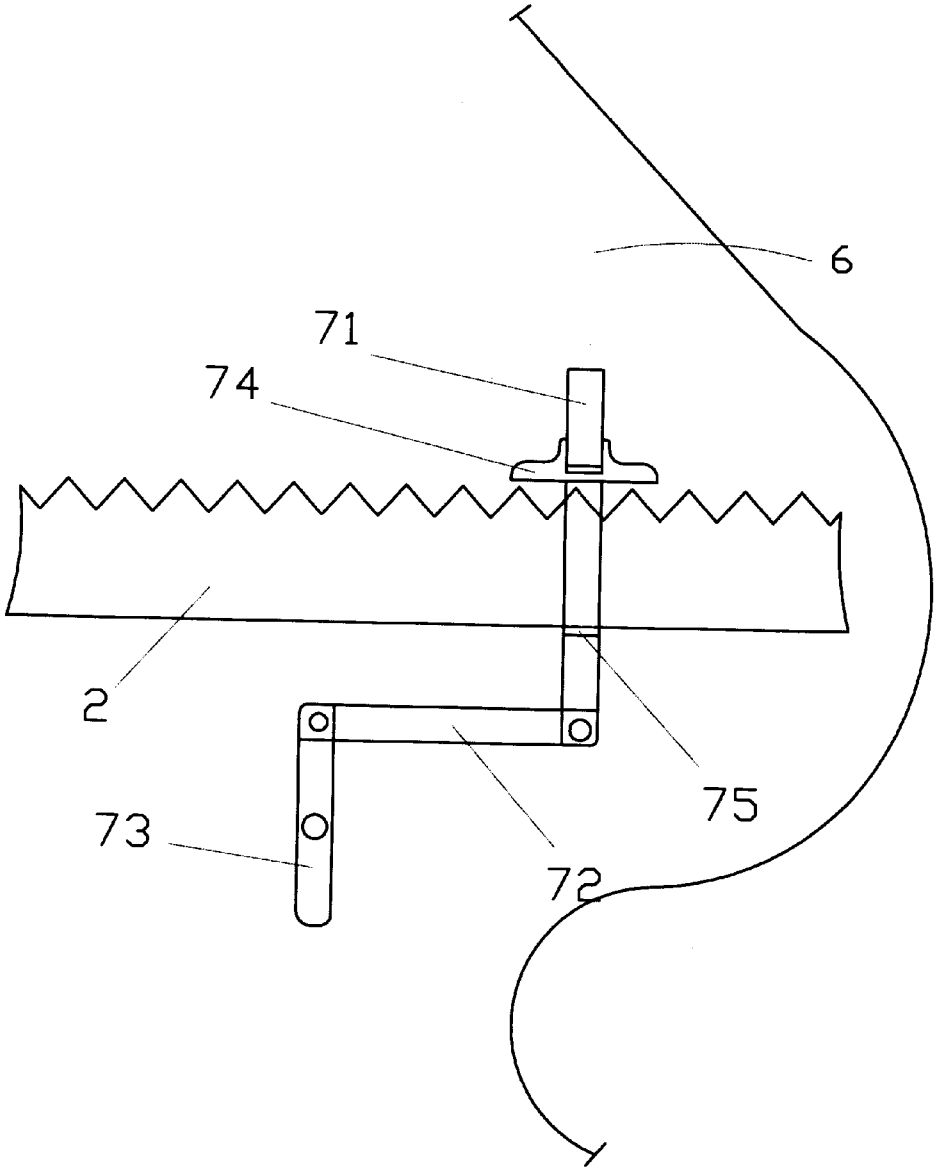
FIG. 6 is a fragmentary plan view showing a braking mechanism included in the driving mechanism of the present invention, wherein the braking mechanism is in a released state.
Figure 7:
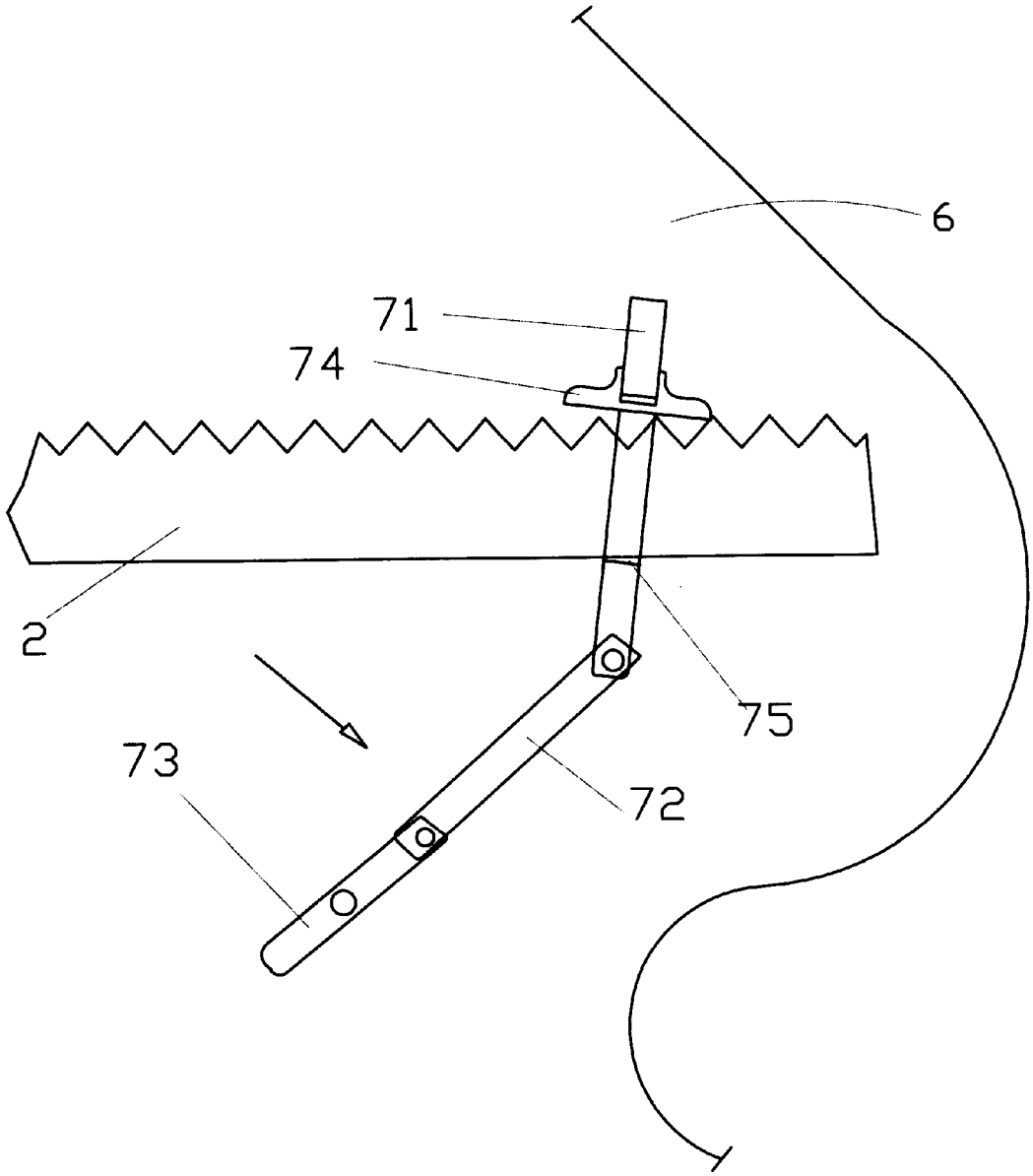
FIG. 7 shows the braking mechanism of FIG. 6 in a braked state.
Figure 9:
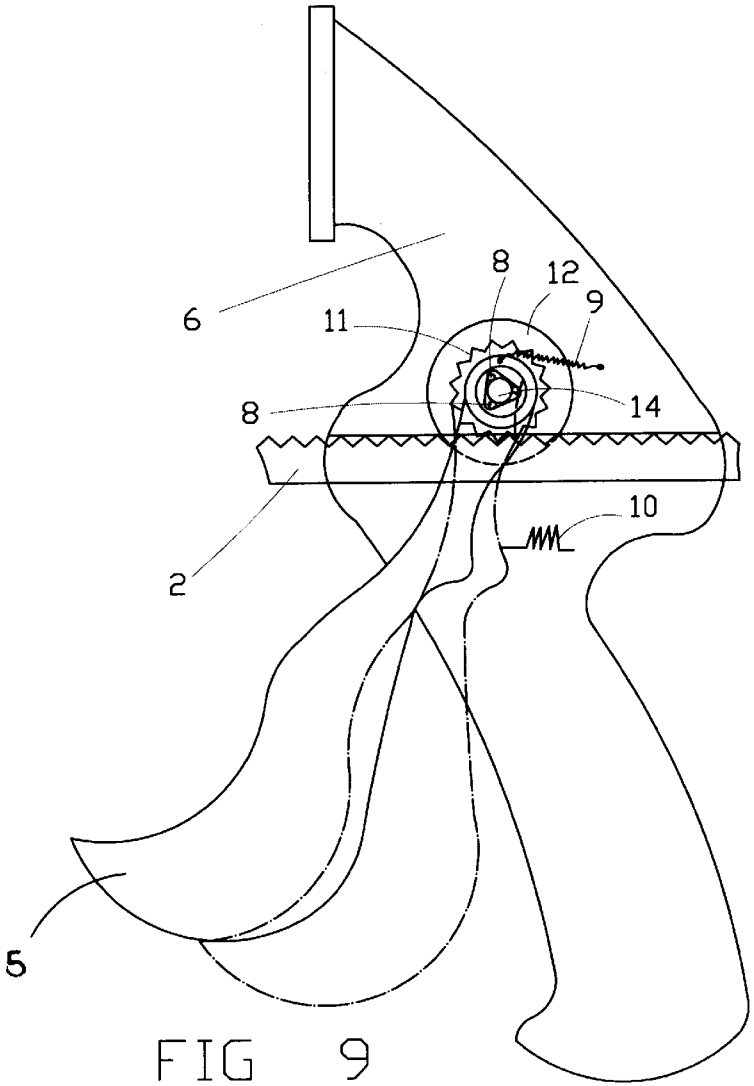
FIGS. 8 and 9 are fragmentary plan views showing the operation of the driving mechanism of the present invention.
Figure 8:
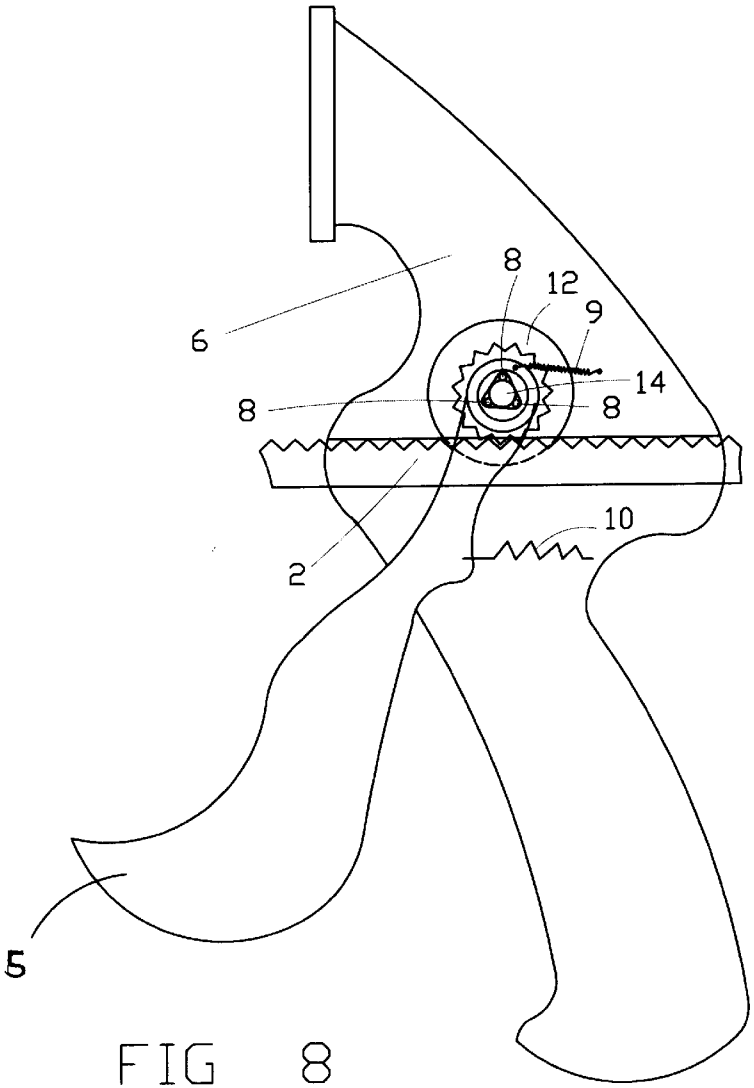
Figure 11:
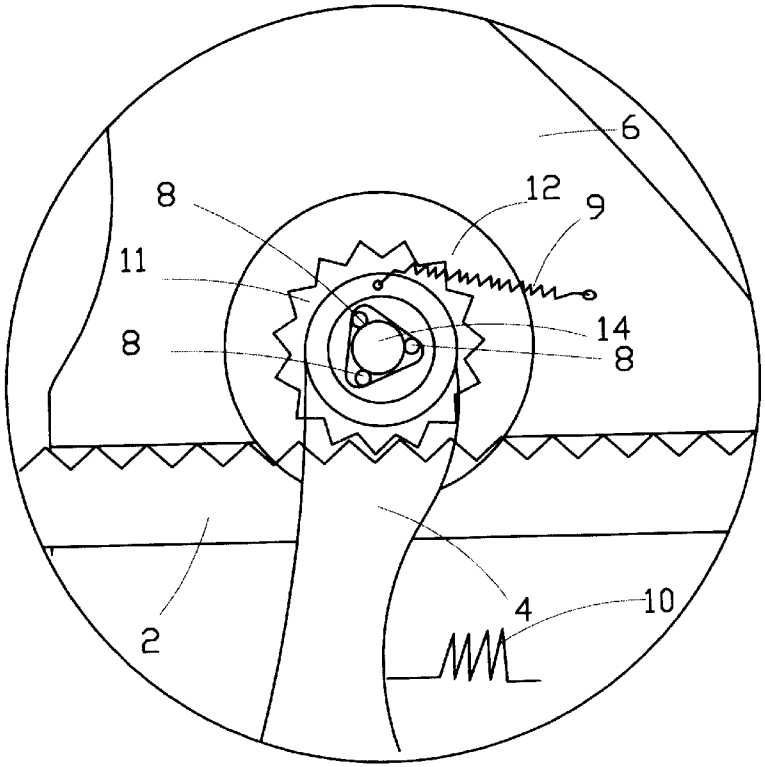
FIGS. 10 and 11 are fragmentary and enlarged plan views of FIGS. 8 and 9, respectively.
Figure 10:
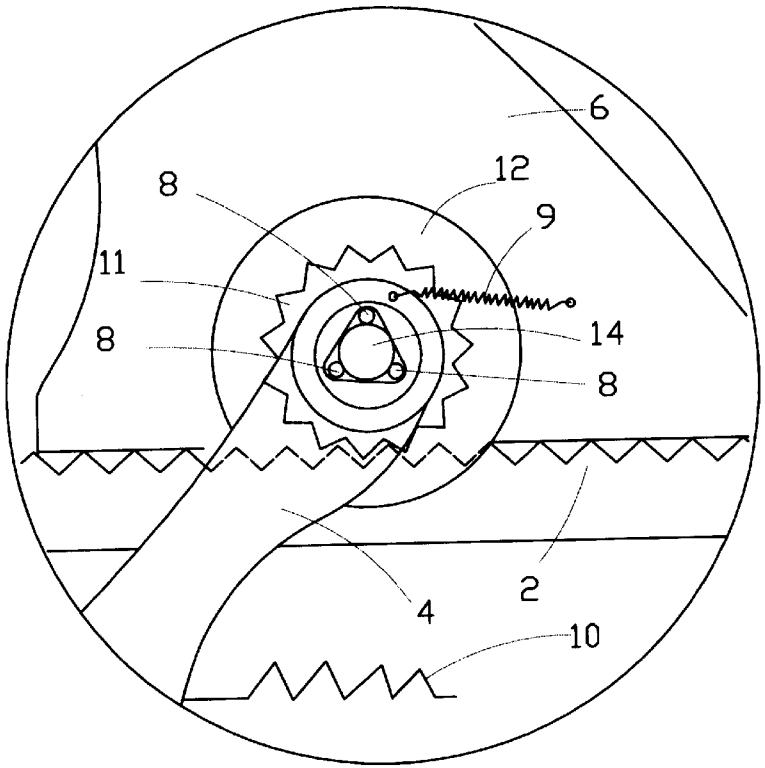

Please refer to FIGS. 6 and 7. The auxiliary brake mechanism mainly includes a plurality of pivotally connected toggle levers 71, 72 and 73. The toggle lever 71 that is located at an upper position in the auxiliary brake mechanism is provided with a stopper 74 and a through hole 75 adjacent to the stopper 74 for the rack 2 to extend there through. When the toggle lever 73 that is located at a lower position opposite to the upper toggle lever 71 is pivotally turned relative to the middle toggle lever 72, the upper toggle lever 71 and accordingly the through hole 75 are inclined by an angle and the stopper 74 is moved into a lowered position, so that the stopper 74 and the inclined through hole 75 become stuck at top and bottom, respectively, of the rack 2 to brake the latter, as shown in FIG. 7. FIGS. 8 and 9 show the operation of the driving mechanism of the present invention. An assembly of the first sleeve 3 and the coupling arm 4 is connected to the gear set 1 by inserting an end of the rotary shaft 14 into the cam-shaped central opening 311. The gear set 1 is installed on the clamp main body 6, so that the rotary shaft 14 of the gear set 1 constitutes a freely rotatable supporting point on the clamp main body 6. When a user holds the plank clamp at the clamp main body 6 with one hand and moves the handle 5 about the rotary shaft 14 toward the clamp main body 6, the coupling arm 4, and accordingly the second sleeve 41 at the head portion thereof, is pivotally turned to move toward the clamp main body 6, too. The coupling arm 4 causes the three rollers 8 enclosed in the cam-shaped bore 42 of the second sleeve 41 to move radially inward on the shank 32 when the coupling arm 4 is turning and therefore be tightly clamped between the rotary shaft 14 and an inner wall surface of the bore 42, as can be clearly seen in FIGS. 10 and 11 that are fragmentary and enlarged views of FIGS. 8 and 9, respectively. The tight contact of the three rollers 8 with the rotary shaft 14 brings the rotary shaft 14 and the gear 11 mounted thereon to rotate at the same time, so that the rack 2 meshing with the gear 11 is brought to move backward relative to the clamp main body 6. A movable jaw 61 of the plank clamp is fixedly connected to a free end of the rack 2 opposite to the clamp main body 6. When the rack 2 moves backward relative to the clamp main body 6, the movable jaw 61 fixed thereto is moved toward the clamp main body 6 that forms a fixed jaw of the plank clamp.

Each time the handle 5 is shifted from an original position to a fully gripped position, the movable jaw 61 connected to the rack 2 is shifted toward the clamp main body 6 by a predetermined distance. And, when the handle 5 is released, the tension spring 9 set between the head disc 31 of the first sleeve 3 and the clamp main body 6 would pull the first sleeve 3, the coupling arm 4 and the handle 5 into an original position. A compression spring 10 is set between the coupling arm 4 and the clamp main body 6 to work with the tension spring 9 to return the coupling arm 4 and the handle 5 to the original position. By repeatedly gripping and releasing the handle 5, the movable jaw 61 could finally be moved to a desired position relative to the clamp main body 6.

What is claimed is:

1. A driving mechanism for plank clamp, comprising:

a gear set including a gear and two wheels coaxially mounted on a rotary shaft, said two wheels having an outer diameter slightly larger than that of said gear and being located at two sides of said gear;

a rack located below said gear set to mesh with said gear;

a first sleeve mounted on said rotary shaft and including a head disc and a hollow shank integrally extended from one said of said head disc;

a coupling arm including a hollow head portion to provide a second sleeve for receiving said shank of said first sleeve therein, and a lower portion forming an integral part of a handle;

a clamp main body on which said gear set and said rack are mounted; and, a movable jaw fixed to said rack and movable with said rack toward said clamp main body.

2. The driving mechanism for plank clamp as claimed in claim 1, wherein said head disc of said first sleeve is provided at a predetermined position with a hole, and a tension spring is connected at a first end to said hole, and at a second end to said clamp main body.

3. The driving mechanism for plank clamp as claimed in claim 1, wherein said head disc of said first sleeve is provided at a central area with a cam-shaped opening to communicate with said hollow shank of said first sleeve and to receive said rotary shaft of said gear set therein.

4. The driving mechanism for plank clamp as claimed in claim 1, wherein said hollow shank of said first sleeve is provided at a circumferential surface with a plurality of axially extended long slots communicable with an internal space of said hollow shank, and each of said plurality of long slots having a roller positioned therein; and said rollers having an outer diameter slightly larger than that of said long slots, such that only one half of a volume of each said roller is received in a corresponding one of said long slots.

5. The driving mechanism for plank clamp as claimed in claim 4, wherein said second sleeve on said head portion of said coupling arm is a hollow housing defining a bore having a cam-shaped profile; and an inner diameter of a cam circle defined by said bore being close to an outer diameter of a circle defined by said plurality of rollers positioned in said long slots on said hollow shank of said first sleeve, so that said shank with said rollers set in said long slots could be inserted into said bore.

6. The driving mechanism for plank clamp as claimed in claim 1, further comprises a compression spring connected at two ends to said coupling arm and said clamp main body at predetermined positions.

7. The driving mechanism for plank clamp as claimed in claim 1, wherein said rotary shaft of said gear set is mounted on said clamp main body to provide a freely rotatable supporting point for said gear set, said second sleeve, and said coupling arm.

* * * * *